US009540890B1

(12) United States Patent
Prasad et al.

(10) Patent No.: US 9,540,890 B1
(45) Date of Patent: Jan. 10, 2017

(54) METHODS AND SYSTEMS FOR TENSIONER CONNECTION

(71) Applicant: Dril-Quip, Inc., Houston, TX (US)

(72) Inventors: Neil B. Prasad, Houston, TX (US); Steven M. Hafernik, Houston, TX (US); Fife B. Ellis, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 14/747,723

(22) Filed: Jun. 23, 2015

(51) Int. Cl.
*E21B 19/00* (2006.01)
*E21B 19/09* (2006.01)
*E21B 17/01* (2006.01)

(52) U.S. Cl.
CPC ..... *E21B 19/004* (2013.01); *E21B 17/01* (2013.01)

(58) Field of Classification Search
CPC ..... E21B 19/004; E21B 19/006
See application file for complete search history.

(56) References Cited

U.S. PATENT DOCUMENTS 4,379,657 A * 4/1983 Widiner ..... E21B 19/006 405/168.4
4,449,854 A * 5/1984 Nayler ..... B66C 13/02 114/264
4,787,778 A * 11/1988 Myers ..... E21B 19/006 166/367
4,892,444 A * 1/1990 Moore ..... E02B 17/003 166/350
5,160,219 A * 11/1992 Arlt ..... E21B 19/24 166/350
5,310,007 A 5/1994 Parikh
7,438,505 B2 * 10/2008 Olsen ..... E02D 27/52 166/355
8,579,034 B2 * 11/2013 Berner, Jr. ..... E21B 19/002 166/241.6
9,341,033 B1 * 5/2016 Jennings ..... E21B 19/006
2007/0196182 A1 * 8/2007 Ellis ..... E21B 19/002 405/224.4
2008/0031692 A1 * 2/2008 Wybro ..... B63B 21/502 405/224.4
2008/0187401 A1 * 8/2008 Bishop ..... E21B 19/002 405/224.4

(Continued)

FOREIGN PATENT DOCUMENTS

GB 2488036 A 8/2012
WO 2009/064941 A2 5/2009

OTHER PUBLICATIONS

Office Action issued in related United Kingdom Application No. GB1610592.6, mailed Nov. 1, 2016 (4 pages).

*Primary Examiner* — Benjamin Fiorello
(74) *Attorney, Agent, or Firm* — Baker Botts L.L.P.

(57) ABSTRACT

Improved methods and systems for connecting a riser tensioner system to a riser are disclosed. A system for coupling a tensioner cylinder to a riser includes a top pin connection disposed at a first distal end of the tensioner cylinder. The top pin connection couples the tensioner cylinder to a platform. The tensioner cylinder includes an extension rod and a bottom pin connection is disposed at a second distal end of the tensioner cylinder on the extension rod. A tension ring is coupled to the riser. An adjustable linkage system is coupled to the tensioner cylinder and includes an attachment mechanism and a positioning mechanism. The adjustable linkage system is operable to couple the tensioner cylinder to the tension ring.

23 Claims, 17 Drawing Sheets

(56) References Cited

U.S. PATENT DOCUMENTS

| | | | | |
|---|---|---|---|---|
| 2009/0145611 | A1* | 6/2009 | Pallini, Jr. | E21B 19/004<br>166/355 |
| 2011/0170955 | A1* | 7/2011 | Koos | E21B 19/006<br>405/224.4 |
| 2012/0207550 | A1* | 8/2012 | Aksel | E21B 19/002<br>405/224.4 |
| 2012/0247783 | A1 | 10/2012 | Berner et al. | |
| 2013/0115012 | A1 | 5/2013 | Aksel et al. | |
| 2015/0361736 | A1* | 12/2015 | Bergan | E21B 19/09<br>414/803 |

* cited by examiner

METHODS AND SYSTEMS FOR TENSIONER CONNECTION

BACKGROUND

The present disclosure relates generally to pull-up riser tensioner systems used on offshore floating production and drilling platforms and, more particularly, to improved methods and systems for connecting a riser tensioner system to a riser.

Offshore production platforms are often used when performing offshore subterranean operations. Such offshore platforms must typically support a riser that extends from the platform to a subsea well. In some instances, the offshore platform may be fixed to ocean floor, thereby readily providing support for the riser as is known in the art. However, in certain deep water implementations using floating platforms such as tension leg platforms or semi-submersible platforms, supporting the risers may prove challenging. Specifically, a floating platform may move up and down or may be displaced horizontally due to oscillations from waves and currents. It is desirable to maintain a predetermined tension on the riser despite the platform oscillations. Accordingly, tensioners are often utilized to maintain a desired tension on the riser as the platform oscillates.

FIG. 1 depicts a typical riser tensioner system in accordance with the prior art. As shown in FIG. 1, a typical pull-up riser tensioner system 100 may include multiple tensioner cylinders 102. In certain implementations, the tensioner cylinders 102 may be hydro-pneumatic cylinders. A lower distal end of the tensioner cylinders 102 may be coupled to a threaded tension ring 104 disposed on a riser 106. As used herein, the term "riser" may refer to both production and drilling risers. The opposite, top distal end of the tensioner cylinders 102 is coupled to the platform structure 108 either directly or through another frame such as a cassette. Accordingly, the tensioner cylinders 102 serve to maintain a substantially constant tension on the riser 106 as the floating platform 108 moves vertically or horizontally due to wind, waves, and other natural events. The tensioner cylinders 102 serve as the connection between the tension ring 104 on the riser 106 and the floating platform 108.

The tensioner cylinders 102 are usually installed on the platform 108 prior to running the riser 106. Accordingly, one of the final steps in running the riser 106 is to couple the riser 106 to the tensioner cylinders 102 and transfer the riser weight from the rig to the tensioners. Typically each tensioner cylinders 102 is connected to the tension ring 104 by a shackle or a pin and bearing connection 110. In order to make that connection, rig personnel are required to manually align each tensioner cylinder 102 individually with the tension ring 104 and secure the shackle or pin in place. However, the current approaches for coupling the tensioner cylinders 102 to the tension ring 104 have a number of drawbacks. For instance, when using the pin and bearing design, there must be a precise alignment between the tensioner cylinders 102 and the tension ring 104 due to tight tolerances. Similarly, the shackles used in tensioner systems weigh over 300 pounds making them difficult to handle with limited to no crane access. Accordingly, the current approach for coupling tensioner cylinders 102 to the tension ring 104 requires rig personnel working in tight spaces and a hazardous environment over the water and handling heavy pins and shackles. It is therefore desirable to develop a more efficient approach for coupling tensioner cylinders to the tension ring on a riser.

BRIEF DESCRIPTION OF THE DRAWINGS

Some specific exemplary embodiments of the disclosure may be understood by referring, in part, to the following description and the accompanying drawings.

Figure 1:
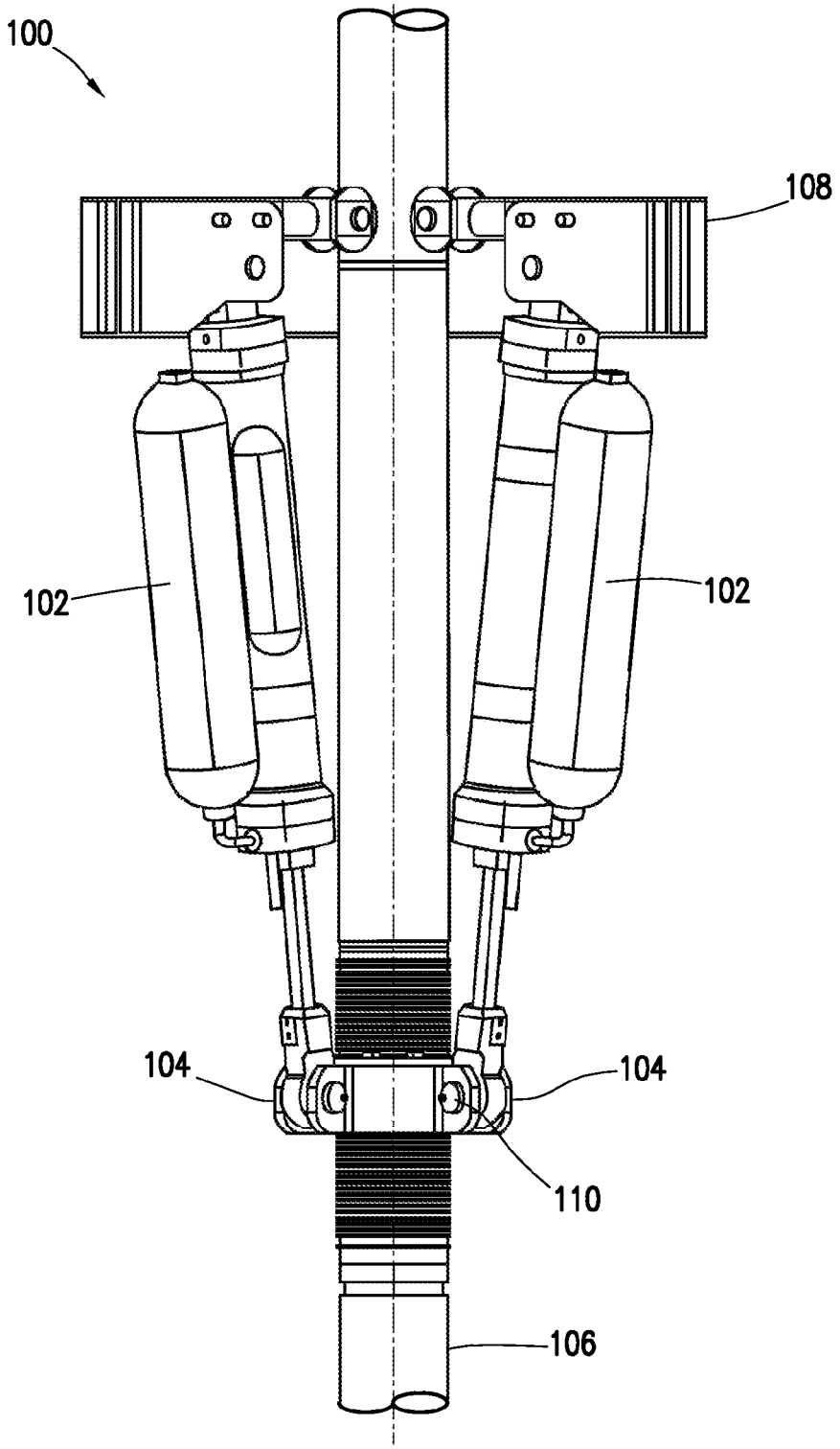
FIG. 1 (PRIOR ART)
FIG. 1 depicts a typical riser tensioner system in accordance with the prior art.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to a tensioning system for use on a floating vessel such as, for example, a spar, a Tension Leg Platform ("TLP"), a drill ship or any other floating vessel used in conjunction with performing subterranean operations.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The term "platform" as used herein encompasses a vessel or any other suitable component located on or close to the surface of the body of water in which a subsea wellhead is disposed. The terms "couple" or "couples," as used herein are intended to mean either an indirect or a direct connection. Thus, if a first device couples to a second device, that connection may be through a direct connection, or through an indirect (electrical and/or mechanical) connection via other devices and connections.

In accordance with illustrative embodiments of the present disclosure as discussed in further detail below, an adjustable linkage system is installed on the tensioner system prior to commencing riser running operations. The adjustable linkage system is designed to align the tensioner cylinders with the tension ring and couple the tensioner cylinders to the tension ring.

In certain embodiments, the adjustable linkage system may be removable once the tensioner cylinder is coupled to the tension ring. However, in certain implementations that require disconnecting and reconnecting the tensioner more frequently, the adjustable linkage system may be permanently installed. The adjustable linkage system may consist of an attachment mechanism and a positioning mechanism. There are a number of different embodiments that may be used to implement the adjustable linkage system. The adjustable linkage system may couple the tensioner cylinders to each other and/or couple the tensioner cylinders back to a rigid structure on the hull. Moreover, the positioning mechanism of the adjustable linkage system may be powered by mechanical, hydraulic, pneumatic or electrical means. In certain implementations, the positioning mechanism is designed to align the tensioner cylinder using rig air.

In certain implementations, the adjustable linkage system aligns all the tensioner cylinders prior to running the riser so that they can be coupled to the tension ring simultaneously. Alternatively, the adjustable linkage system may couple the tensioner cylinders to the tension ring sequentially. As the tension joint reaches the production deck, rig personnel can verify alignment with the tensioner cylinders. Once the tension ring is lowered into place, the positioning mechanism of the adjustable linkage system rotates the tensioner cylinders towards the tension ring. The tensioner cylinders may include an extension rod and may be partially extended to allow engagement with the tension ring. In certain implementations, once the tensioner cylinder is coupled to the tension ring and the riser is supported by the tensioner cylinders the adjustable linkage system may be removed. Certain illustrative embodiments of the present invention are now discussed in more detail in conjunction with the figures.

Figure 2A:
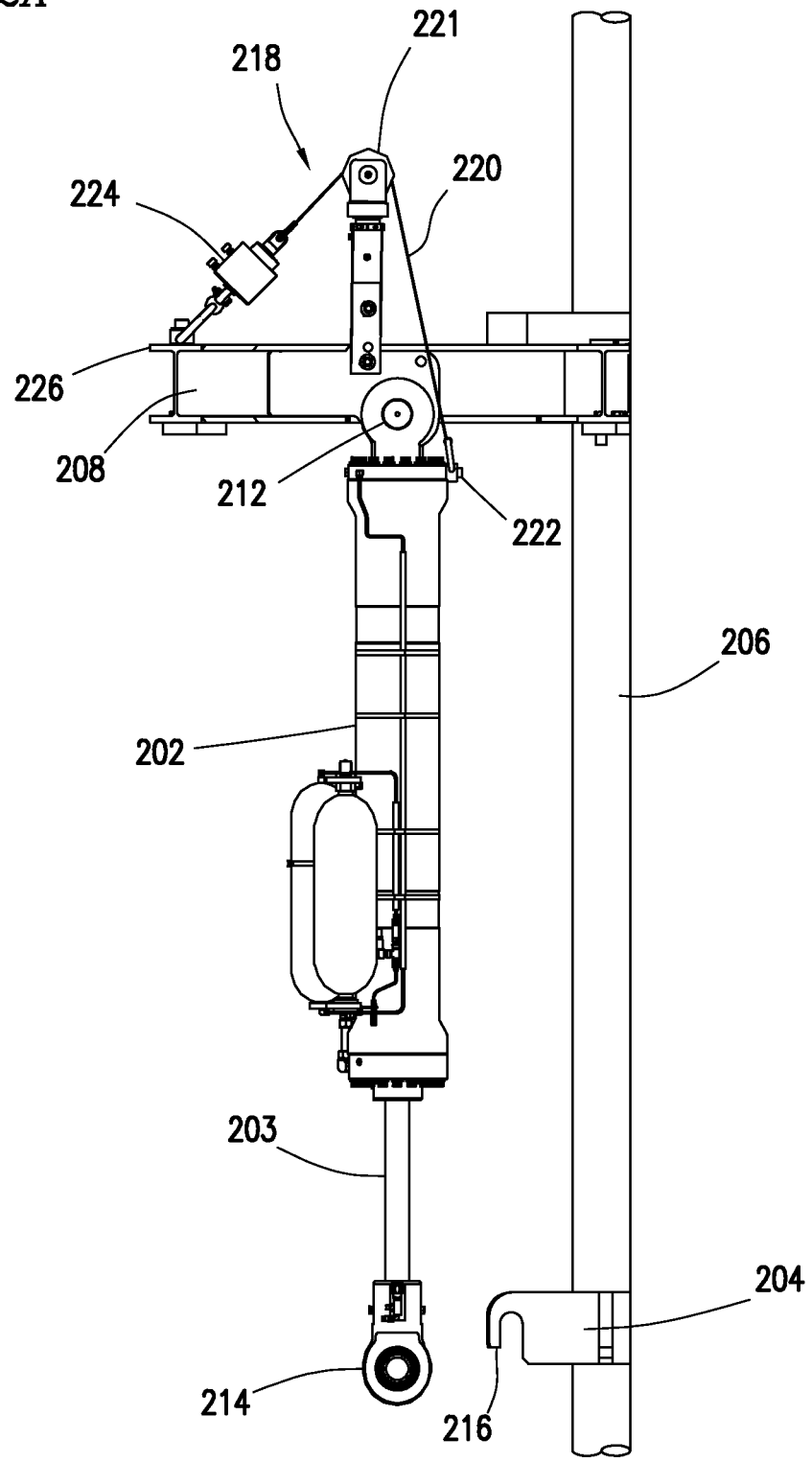
FIGS. 2A-2C depict an improved tensioner connection system in accordance with a first illustrative embodiment of the present disclosure.
Figure 2B:
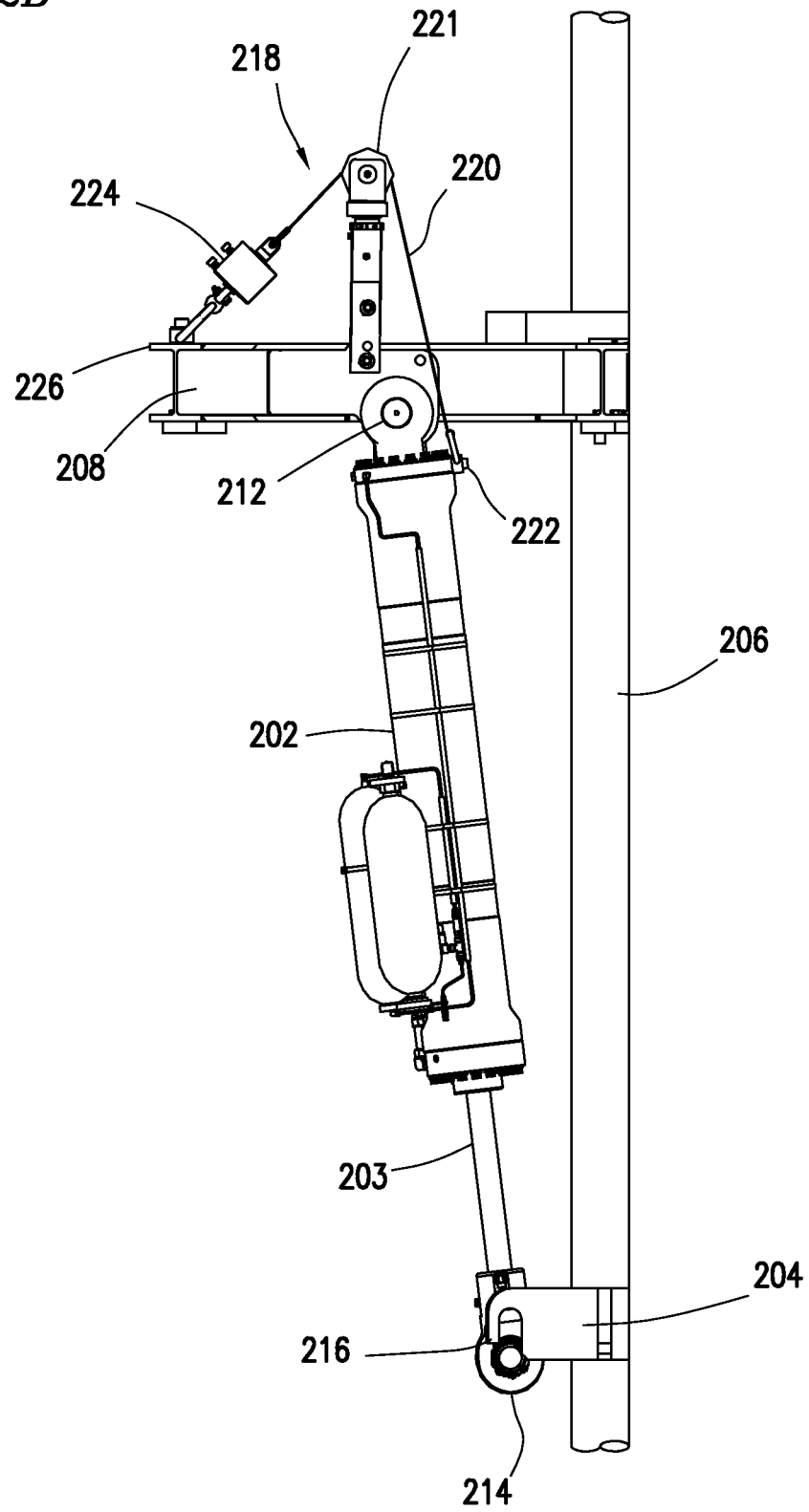
Figure 2C:
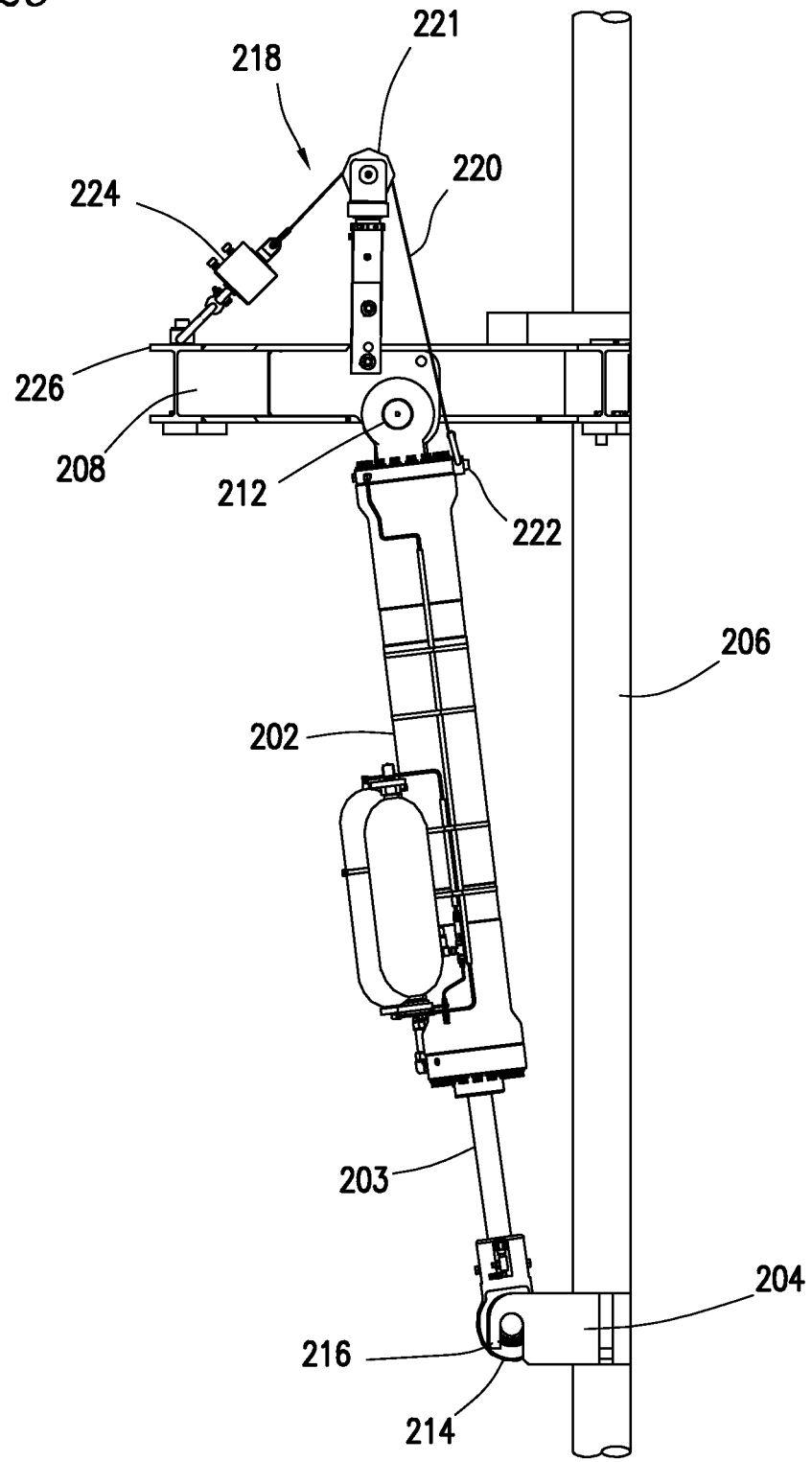

Turning now to FIG. 2A-2C, an improved tensioner connection system in accordance with a first illustrative embodiment of the present disclosure is denoted generally with reference numeral 200. A riser 206 is directed through a platform 208 and a tensioning ring 204 is coupled to the riser 206. The tensioning ring 204 may include a retention device 216. In certain implementations, the retention device 216 may be spring loaded. A tensioner cylinder 202 is coupled to the platform 208. The term "tensioner cylinder" as used herein is intended to encompass any suitable type of cylinder known to those of ordinary skill in the art, having the benefit of the present disclosure such as, for example, a hydro-pneumatic cylinder. The tensioner cylinder 202 may further include a retractable extension rod 203 that may selectively be extended from or retracted into the tensioner cylinder 202. The tensioner cylinder 202 may further include a top pin connection 212 at a first distal end thereof proximate to the platform 208 and a bottom pin connection 214 at a second distal end thereof proximate to the tensioning ring 204. The top pin connection 212 may be used to couple the tensioner cylinder 202 to the platform 208 with the tensioner cylinder 202 rotatable around the top pin connection 212. In certain implementations, the retention device 216 may be comprised of a downward facing hook that engages the portions of the bottom pin connection 214 extending from the distal end of the extension rod 203 of the tensioner cylinder 202.

In certain implementations, the positioning mechanism of the adjustable linkage system may be a rotating mechanism 218. Specifically, the tensioner cylinder 202 may be rotated around the top pin connection 212 using a rotating mechanism 218. In certain embodiments, the rotating mechanism 218 may include a flexible member 220 that rolls over a centralizer roller 221 and is coupled at one distal end thereof to a mounting point 222 on the tensioner cylinder 202 and at a second distal end thereof to a rotation device 224. In certain illustrative embodiments, the flexible member 220 may be a strap or a wire rope. As would be appreciated by those of ordinary skill in the art, having the benefit of the present disclosure, in certain implementations, the centralizer roller 221 may be replaced by a separate installation roller without departing from the scope of the present disclosure. In certain embodiments, the flexible member 220 may be a nylon or other non-marring strap. The rotation device 224 may be any suitable device known to those of ordinary skill in the art, having the benefit of the present disclosure. For instance, the rotation device 224 may be a cylinder or a threaded member. Specifically, in certain implementations, the rotation device 224 may be any suitable cylinder known to those of ordinary skill in the art, having the benefit of the present disclosure such as, for example, a hydraulic or pneumatic cylinder. However, other suitable types of cylinders may be used without departing from the scope of the present disclosure. Additionally, in certain implementations, the rotation device 224 may be a double acting cylinder. Further, in certain implementations, the rotation device 224 may be a threaded member such as, for example, a turnbuckle. A first end of the rotation device 224 is coupled to the flexible member 220 and a second end of the rotation device 224 is coupled to a mounting point 226 disposed on the platform 208. Accordingly, an improved tensioner connection system in accordance with a first embodiment of the present disclosure comprises an adjustable linkage system which consists of an attachment mechanism (the bottom pin connection 214 and retention device 216 of the tension ring 204) and a positioning mechanism (in this illustrative embodiment, the rotating mechanism 218).

Although one tensioner cylinder 202 is depicted in FIG. 2 (as well as FIGS. 3 and 4 discussed in further detail below), the methods and systems disclosed herein are not limited to any particular number of tensioner cylinders. Accordingly, as would be appreciated by those of ordinary skill in the art having the benefit of the present disclosure, any number of tensioner cylinders may be used without departing from the scope of the present disclosure. For instance, in certain implementations, four tensioner cylinders may be used.

The operation of the improved tensioner connection system in accordance with a first illustrative embodiment of the present disclosure will now be described in conjunction with FIGS. 2A, 2B and 2C. Specifically, FIG. 2A depicts the tensioner cylinder 202 in its free hanging position; FIG. 2B depicts the tensioner cylinder in its "pulled in" position; and FIG. 2C depicts the tensioner cylinder 202 in its installed position within the tension ring 204. As shown in FIG. 2A, the riser 206 having a tension ring 204 is directed down through the platform 208. In the illustrative embodiment of FIG. 2, the retention device 216 can be selectively activated and deactivated. As shown in FIG. 2A, the retention device 216 of the tension ring 204 is initially in its deactivated state and the extension rod 203 extending from the tensioner cylinder 202 is initially in its extended position in order to ensure that the bottom pin connection 214 can engage the tensioner ring 204 and its associated retention device 216.

The initial position of the tensioner cylinder 202 is depicted for illustrative purposes only. Accordingly, as would be appreciated by those of ordinary skill in the art, having the benefit of the present disclosure, the tensioner cylinder 202 may initially be in its extended position, in its retracted position or in some point between these two positions without departing from the scope of the present disclosure. In order to couple the tensioner cylinder 202 to the tension ring 204, first the positioning mechanism of the adjustable linkage system is activated. Specifically, the rotation device 224 is activated and pulls on the flexible member 220. As the flexible member 220 is pulled, the tensioner cylinder 202 rotates around the top pin connection 212 and the bottom pin connection 214 moves towards the retention device 216 of the tension ring 204. As shown in FIG. 2B, the extension rod 203 is then retracted to its "pulled-in" position to interface the bottom pin connection 214 with the retention device 216 of the tension ring 204. Alternatively the riser 206 may be lowered to engage the tensioner cylinder 202.

Next, as shown in FIG. 2C, the extension rod 203 is pulled further in order to fully engage the bottom pin connection 214 of the tensioner cylinder 202 with the retention device 216 of the tensioner ring 204. The retention device 216 is then activated and closes after the bottom pin connection 214 has fully engaged the tension ring 204. In certain embodiments, the retention device 216 may include a mechanism to pivotally lock the bottom pin connection 214 in place. For instance, in certain illustrative implementations, the retention device may be spring loaded, gravity activated, or pressure activated. Accordingly, in order to decouple the tensioner cylinder 202 from the tension ring 204, the retention device 216 may be disengaged with any suitable mechanism such as, for example, a mechanical disengaging system, a hydraulic disengaging system, a pneumatic disengaging system or an electric disengaging system. Once the retention device 216 is disengaged, the rotating mechanism 218 may be used to safely permit the tensioner cylinder 202 to swing outwards to a resting position under its own center of gravity.

In the illustrative embodiment of FIG. 2, the positioning mechanism of the adjustable linkage system is designed to pull the tensioner cylinder 202 in only one direction. However, as would be appreciated by those of ordinary skill in the art having the benefit of the present disclosure, in certain implementations (as shown in the illustrative embodiments discussed below), it may be desirable to both push and pull the tensioner cylinders 202 to, for example, provide clearance for passing a tie-back connector. FIGS. 3A-D depict an improved tensioner connection system 300 in accordance with a second illustrative embodiment of the present disclosure where the positioning mechanism of the adjustable linkage system is a double acting rotation mechanism 318 and where the attachment mechanism operates in the same manner discussed in conjunction with FIG. 2.

Figure 3A:
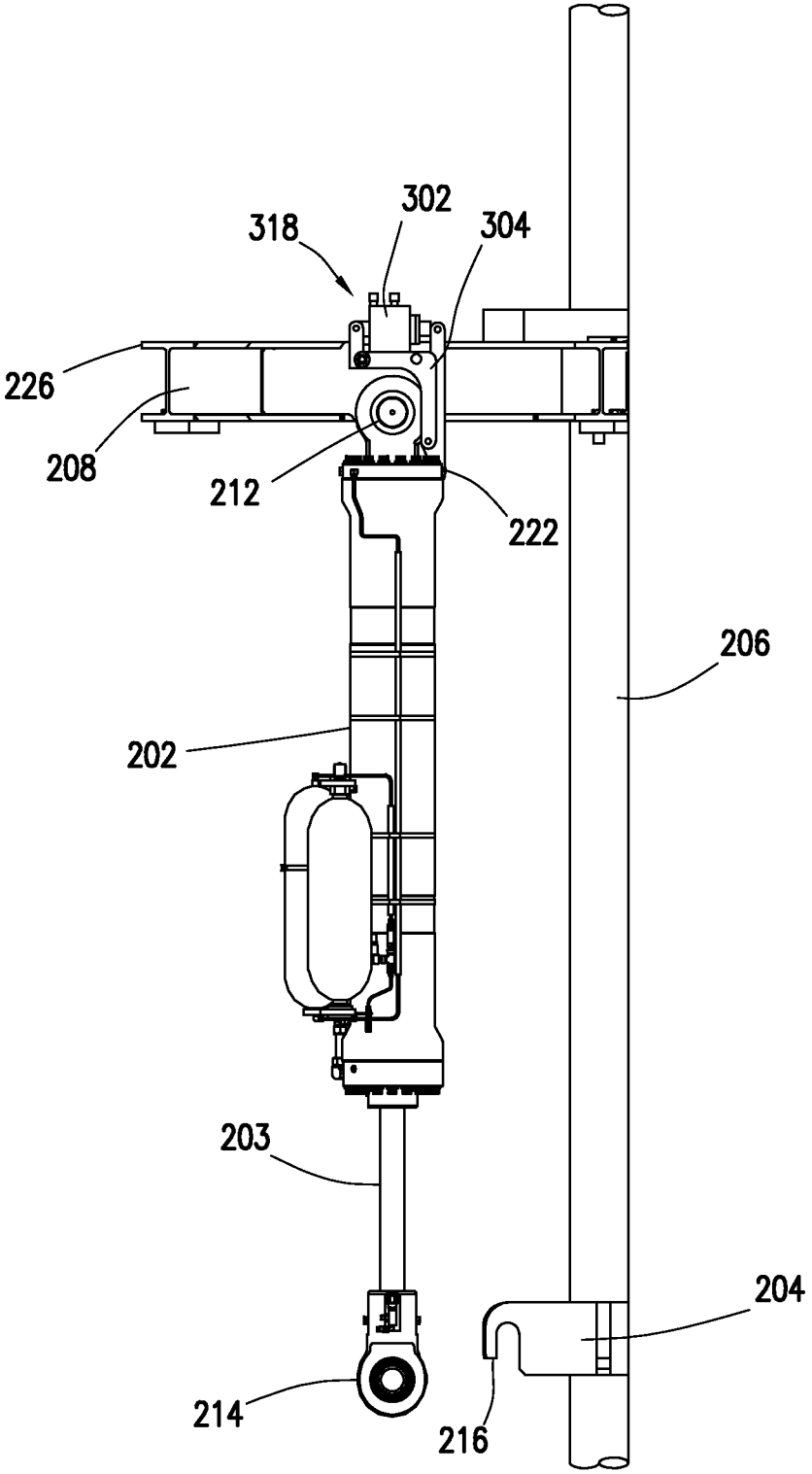
FIGS. 3A-3D depict an improved tensioner connection system in accordance with a second illustrative embodiment of the present disclosure.
Figure 3B:
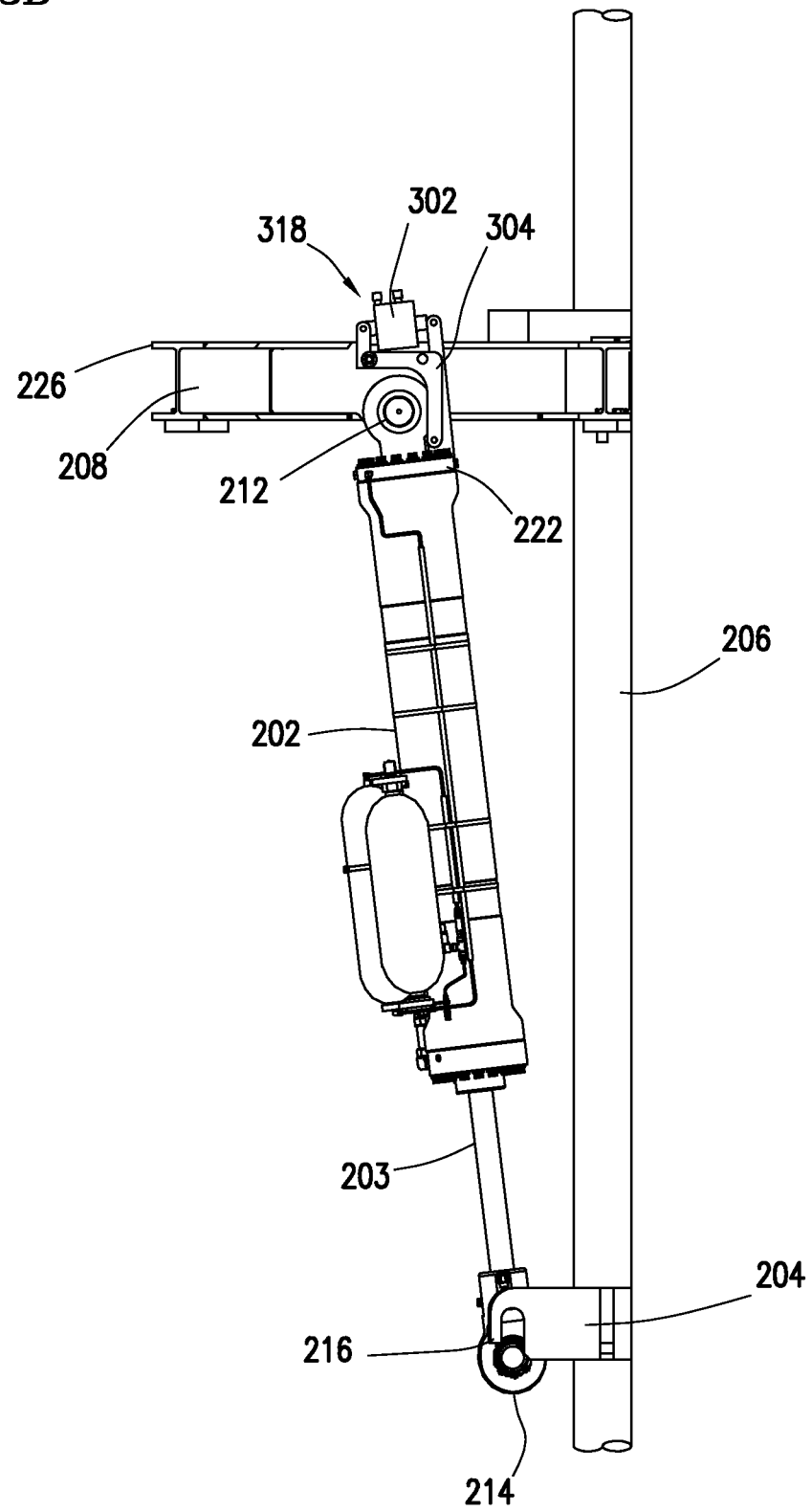
Figure 3C:
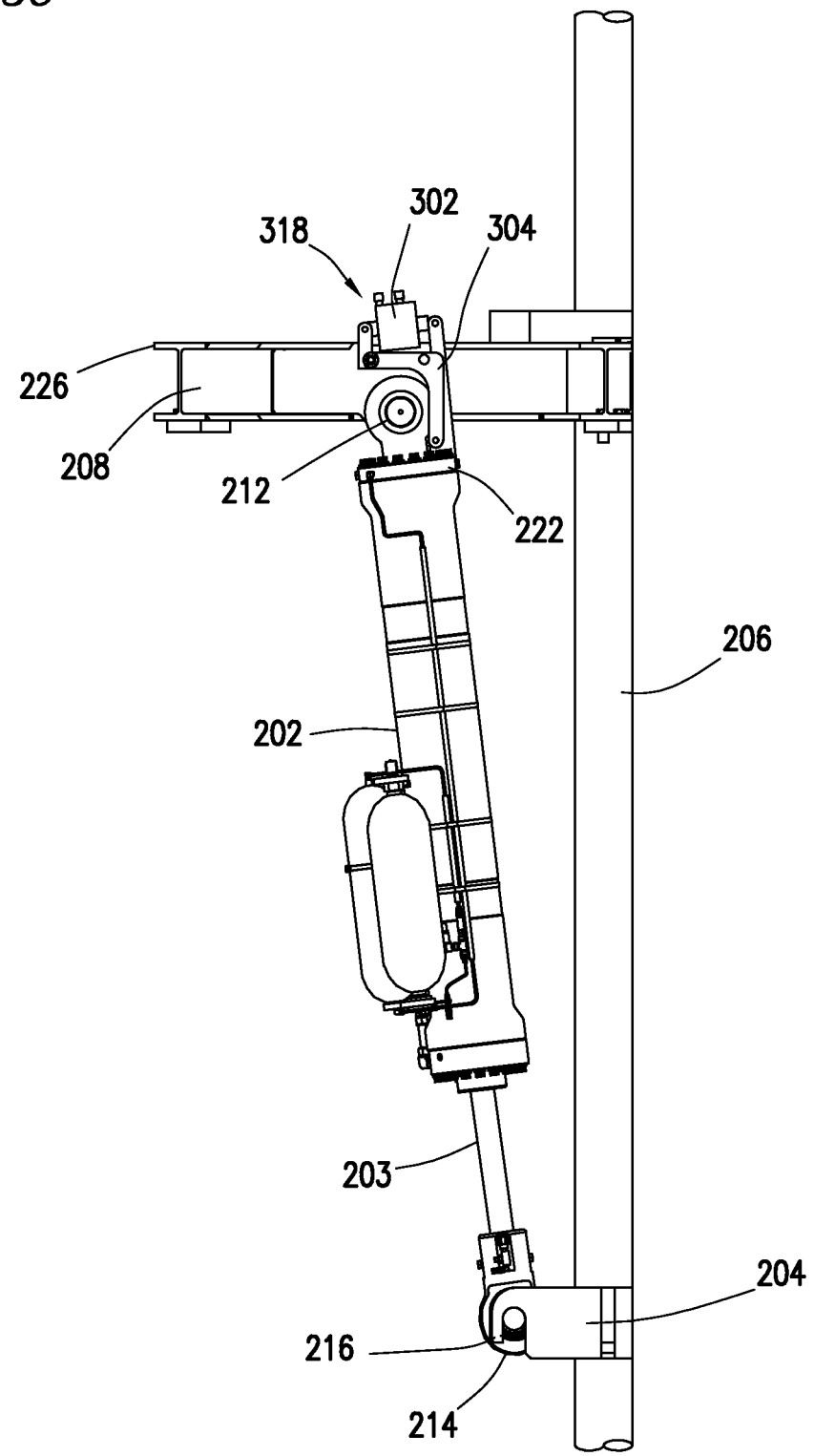

Specifically, FIG. 3A depicts the tensioner cylinder 202 in its free hanging position; FIG. 3B depicts the tensioner cylinder 202 in its "pulled in" position; FIG. 3C depicts the tensioner cylinder 202 in its installed position within the tension ring 204; and FIG. 3D depicts the tensioner cylinder 202 in its position away from the tension ring 204.

In this embodiment, the rotating mechanism 218 of the adjustable linkage system of FIG. 2 is replaced with a double acting rotation mechanism 318. In certain implementations, the double acting rotation mechanism 318 may comprise a double acting rotation cylinder 302 and a solid link 304 that allows the tensioner cylinder 202 to be rotated in either direction. The rotation mechanism 318 may be coupled with the tensioner cylinder 202 at the mounting point 222 (as in FIGS. 2A-2C) or anywhere else on the tensioner cylinder 202 where it can effectively rotate the tensioner cylinder 202 about the top pin connection 212. The attachment mechanism of the adjustable linkage system remains substantially the same with some modifications. For instance, as shown in FIG. 3, the attachment mechanism is no longer attached to the top of the platform 208. Instead, the attachment mechanism may interface with mounting locations of the centralizer arm or it may directly interface with an installed centralizer arm. In certain implementations, the attachment mechanism may be built into the centralizer arm and/or act as an extension of the centralizer arm so that the centralizer arm would not need to be removed or be uprighted.

In certain embodiments, the rotating cylinder 302 may be a double acting hydraulic or pneumatic cylinder having both pull and push capabilities. Certain components of the embodiment of FIG. 3 operate in the same manner as described in conjunction with FIG. 2 and are identified using the same numerals used in that figure. As shown in FIG. 3A, the tensioner cylinder 202 is initially in its free hanging position. When it is desirable to couple the tensioner cylinder 202 to the tension ring 204, pressure is applied to a first side of the rotating cylinder 302. The rotating cylinder 302 is coupled to the tensioner cylinder 202 via a solid link 304. Accordingly, as pressure is applied to the first side of the rotating cylinder 302, the solid link 304 moves the tensioner cylinder 202 towards the tensioner ring 204, aligning the extension rod 203 with the retention device 216 of the tension ring 204 and bringing the tensioner cylinder 202 into its "pulled in" position as shown in FIG. 3B. Finally, pressure is applied to the working side of the tensioner cylinder 202, retracting the extension rod 203 and forcing the bottom pin connection 214 of the tensioner cylinder 202 into the retention device 216 of the tension ring 204 as shown in FIG. 3C. As discussed in conjunction with FIG. 2, the retention device 216 may include a mechanism to pivotally lock the bottom pin connection 214 in place and prevent the bottom pin connection 214 from being removed.

Figure 3D:
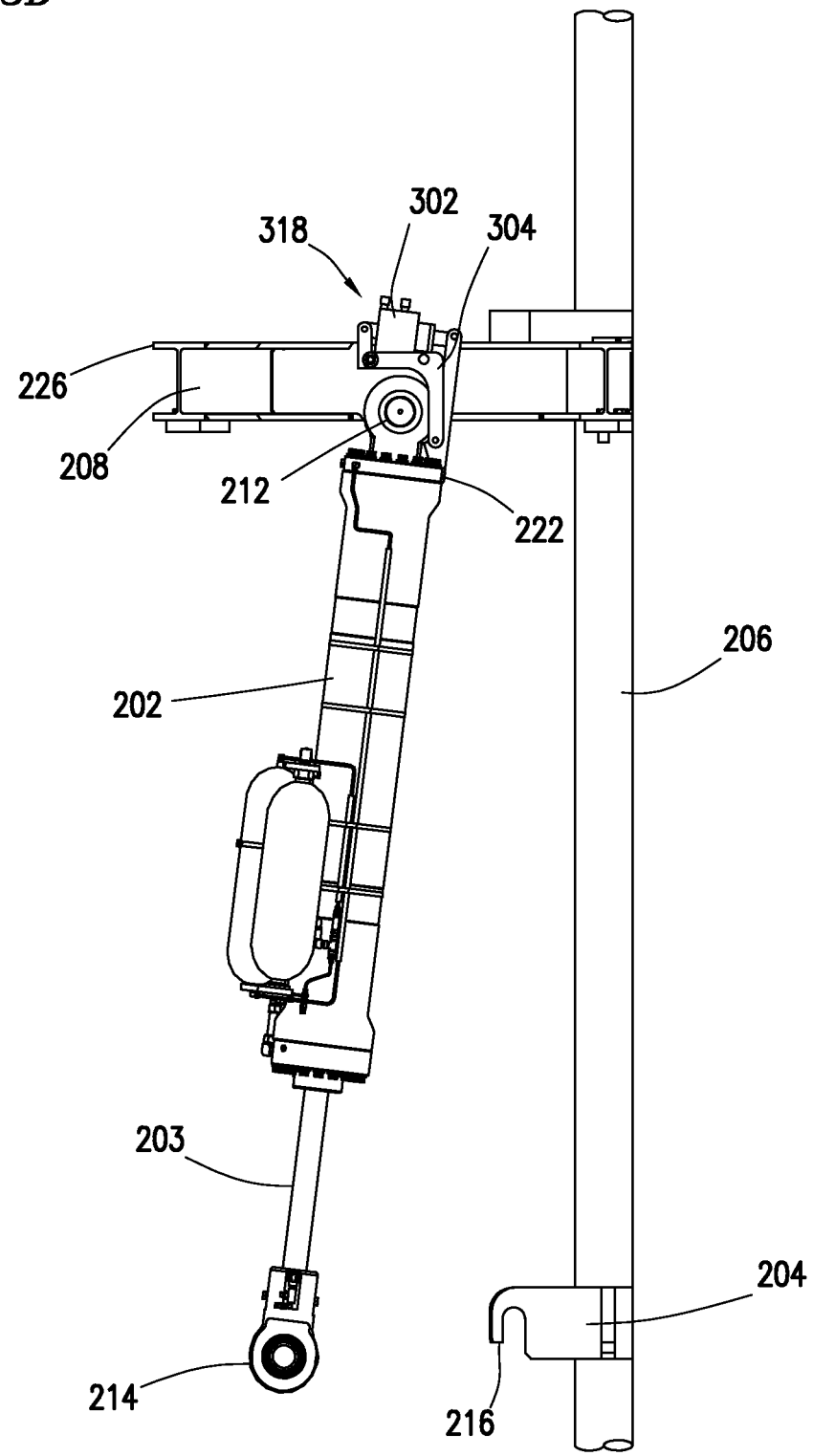

Alternatively, as shown in FIG. 3D, pressure may be applied to a second side of the rotating cylinder 302 and the solid link 304 may move the tensioner cylinder 202 away from the tensioner ring 204. Accordingly, the double acting rotation mechanism 318 may push the tensioner cylinder 202 away from the tension ring 204 (for example, for running the riser 206 wherein a large opening diameter through the platform structure may be desired) and it may pull the tensioner cylinder 202 in towards the tension ring 204 (for example, for installation) as desired.

Figure 4A:
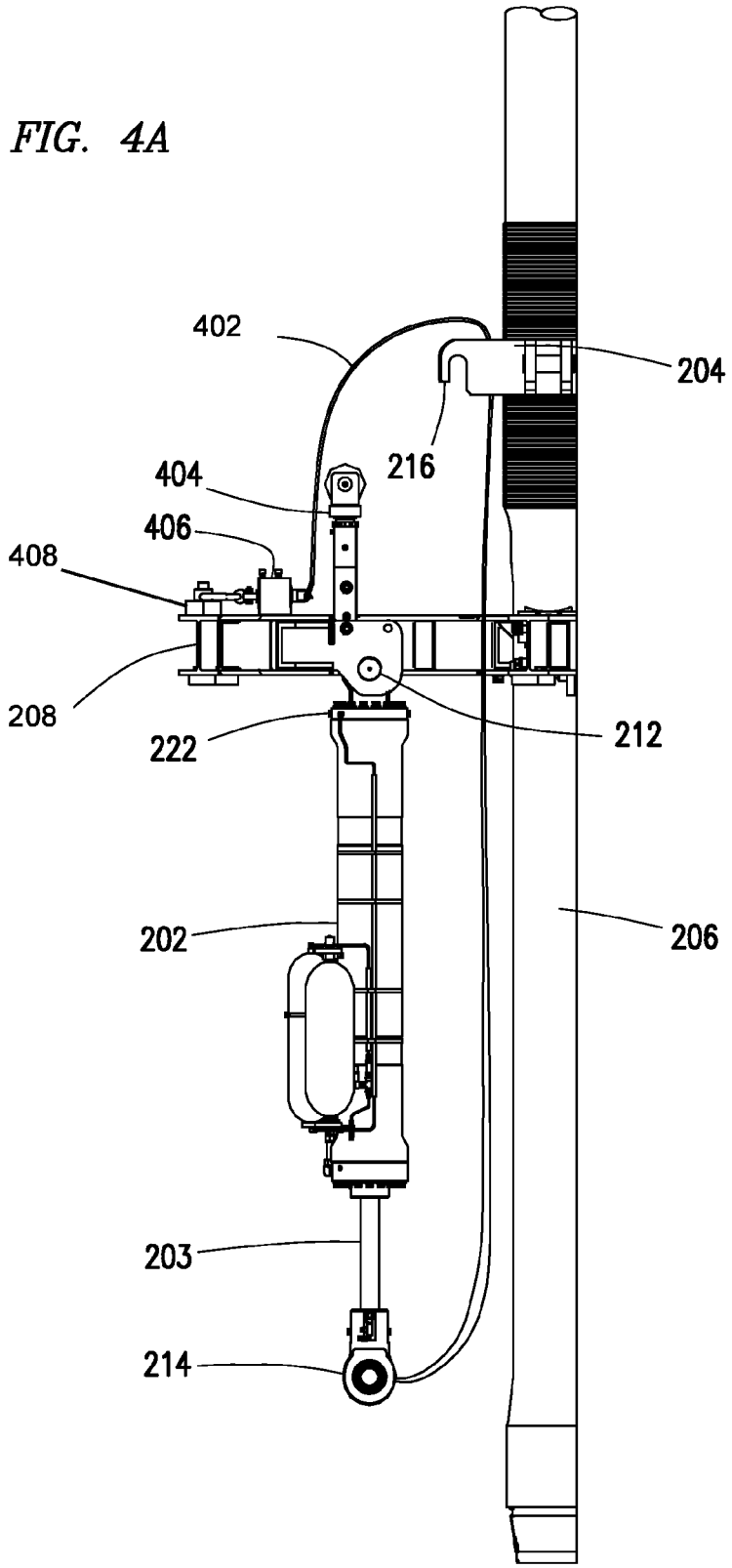
FIGS. 4A-4D depict an improved tensioner connection system in accordance with a third illustrative embodiment of the present disclosure.
Figure 4B:
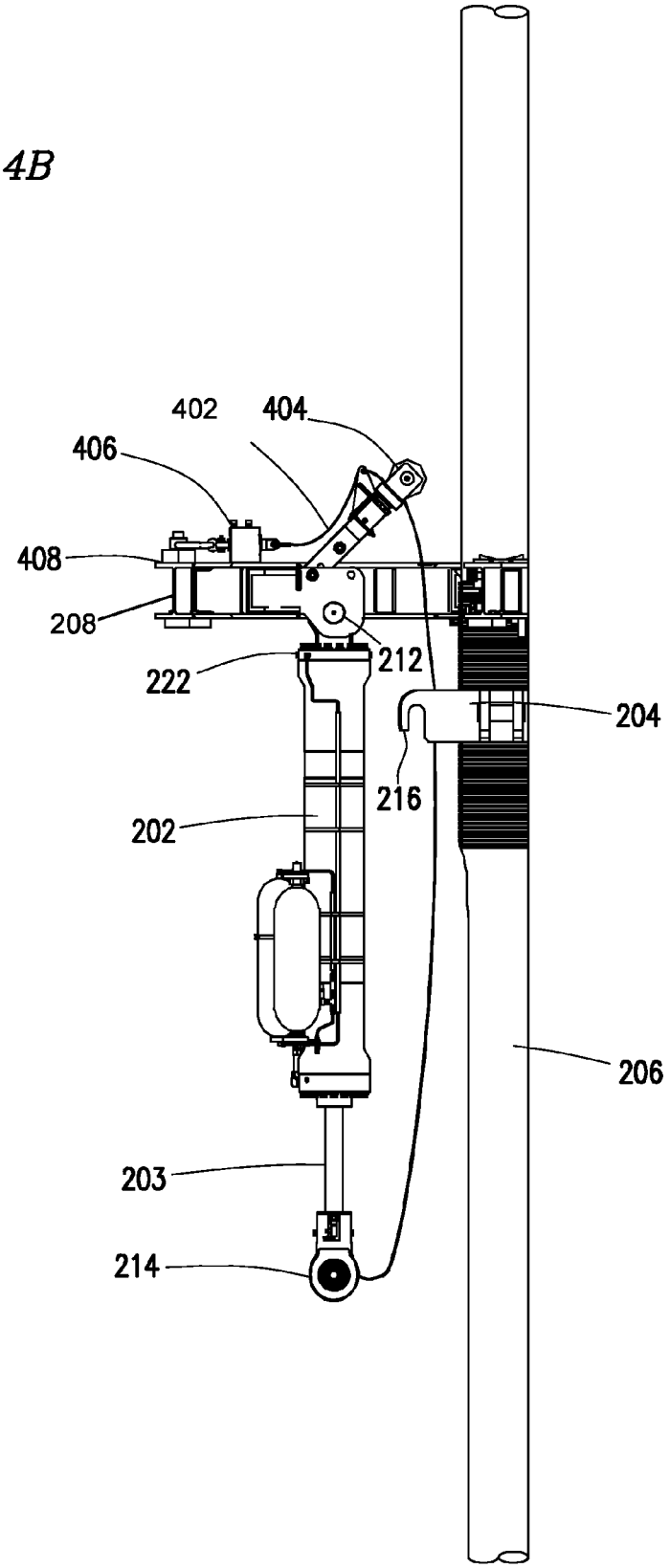
Figure 4C:
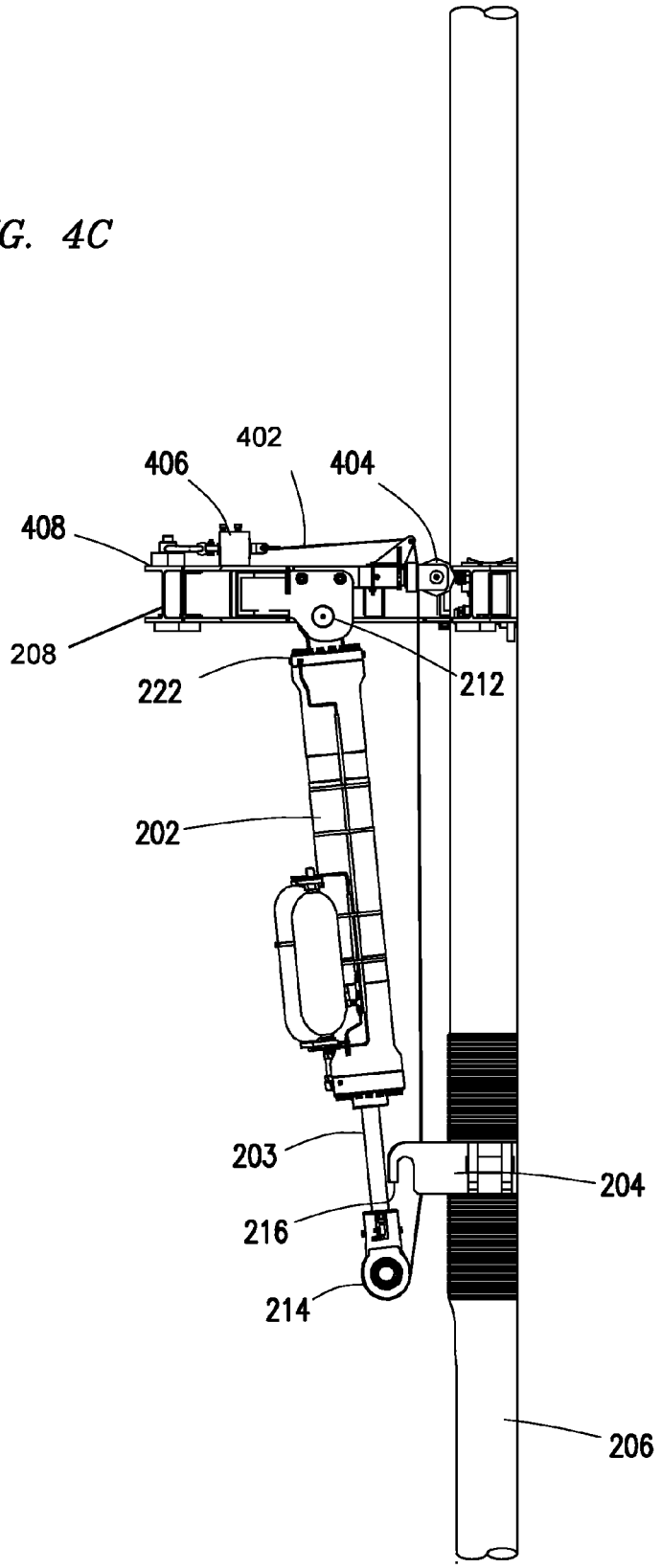
Figure 4D:
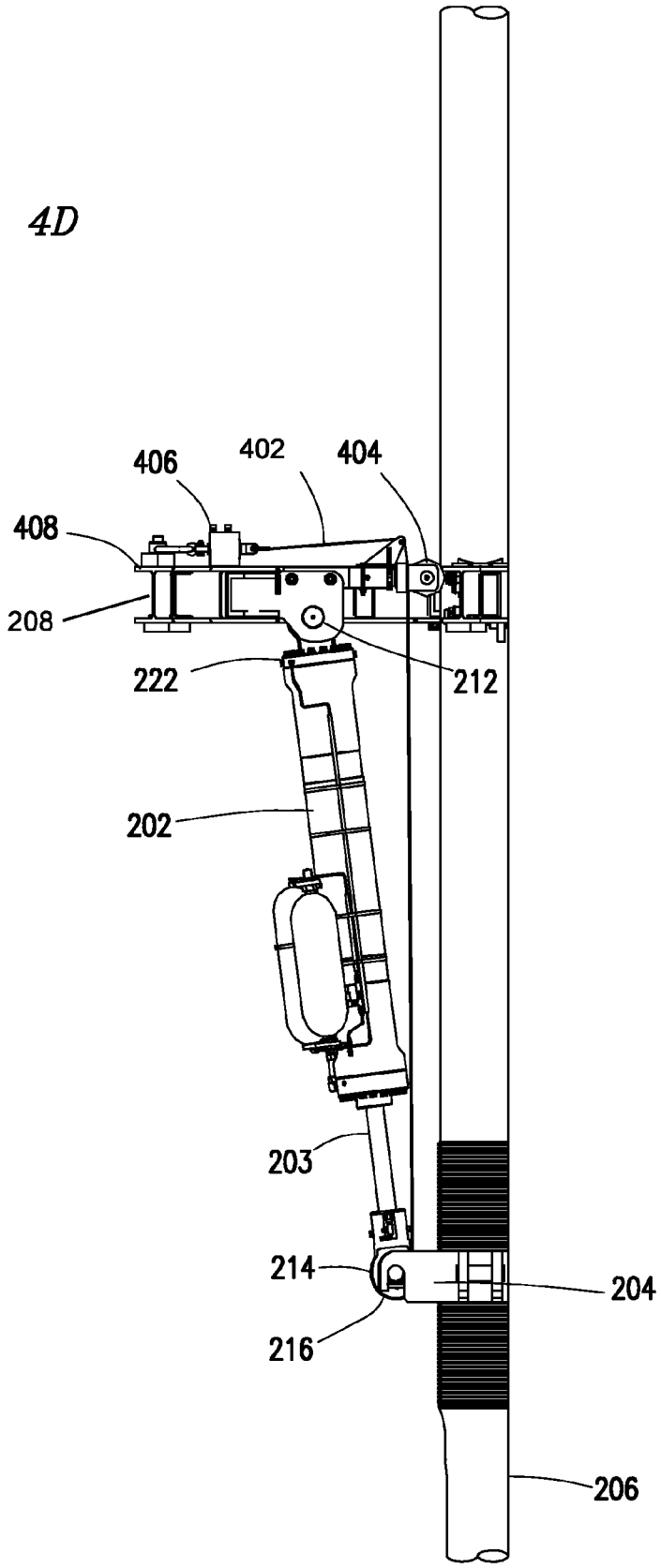

FIGS. 4A-4D depict an improved tensioner connection system in accordance with a third illustrative embodiment of the present disclosure where the attachment mechanism operates in the same manner discussed in conjunction with FIG. 2 and the positioning mechanism of the adjustable linkage system comprises a mechanical link attached to a lower end of the tensioner cylinder 202. Specifically, FIG. 4A depicts the tensioner cylinder 202 in its free hanging position; FIG. 4B depicts the tensioner cylinder 202 with a centralizer arm 404 rotated down to centralizer the riser 206; FIG. 4C depicts the tensioner cylinder 202 in its "pulled in" position; and FIG. 4D depicts the tensioner cylinder 202 in its installed position within the tension ring 204. Certain components of the embodiment of FIG. 4 operate in the same manner as described in conjunction with FIG. 2 and are identified using the same numerals used in that figure. 402

As shown in FIG. 4A, a distal end of the extension rod 203 of the tensioner cylinder 202 is coupled to a mechanical link 402 which is in turn, routed through the tension ring 204 and held in tension. In certain implementations, the mechanical link 402 may be a rope or strap. For instance, in certain implementations, the mechanical link 402 may be a nylon or other non-marring strap or a wire rope. A centralizer arm 404 is coupled to the platform 208 and provides a clearance for the tension ring 204. A first distal end of the mechanical link 402 may be looped through a hook at a distal end of the extension rod 203 so that it can be retrieved without a need for access below the deck. The second distal end of the mechanical link 402 may be coupled to a cylinder 406 fastened to a mounting point 408 on the platform 208. The cylinder 406 may be any suitable cylinder such as, for example, a hydraulic or pneumatic cylinder and if desirable, may be a double acting cylinder. As the riser 206 (and the tension ring 204) is lowered, the cylinder 406 acts as an elastic member to ensure that the movement of the riser 206 does not pose any safety concerns by overloading the elastic member. In certain implementations, the cylinder 406 may not be used and the mechanical link 402 may be directly coupled to a mounting point on the platform 208.

In operation, the tensioner cylinder 202 is initially free hanging when running the riser 206 as shown in FIG. 4A. At this stage, the mechanical link 402 is loose. The tension ring 204 moves down as the riser 206 is lowered and eventually, the mechanical link 402 contacts the centralizer arm 404 as shown in FIG. 4B. Specifically, once the tension ring 204 has passed beneath the envelope of the platform 208, the centralizer arm 404 may be lowered and secured into place on the platform 208. The mechanical link 402 may then be routed over the centralizer arm 404 (or another routing device) and secured to an open end of the cylinder 406. As the riser 206 continues to be lowered, the centralizer arm 404 rotates down in order to centralize the riser 206 during installation. Additionally, as shown in FIG. 4B, the extension rod 203 of the tensioner cylinder 202 is stroked out in order to ensure that the extension rod 203 can engage the tension ring 204. The stroke range of the extension rod 203 may range anywhere from a fully retracted stroke (zero stroke) to a fully extended stroke. However, in this embodiment, retraction of the cylinder 402 is not necessary to cause engagement of the bottom pin connection 214 to the tension ring 204 or the retention device 216. As shown in FIGS. 4C and 4D, as the riser 206 is lowered, the mechanical link 402 tightens and pulls the tensioner cylinder 202 towards the tension ring 204 until they engage and latch using the attachment mechanism of the adjustable linkage system. Specifically, the tensioner cylinder 202 is guided towards the tension ring 204 as the riser 206 is lowered (FIG. 4C). Once the riser 206 is lowered a predetermined distance, the bottom pin connection 214 interfaces with the tension ring 204 and is retained therein when the retention device 216 of the tension ring 204 is activated (FIG. 4D). Linking the tensioner cylinder 202 directly to the tension ring 204 in this manner eliminates concerns about misalignment as the tensioner cylinder is pulled directly into its latching point in the retention ring 204.

Figure 5A:
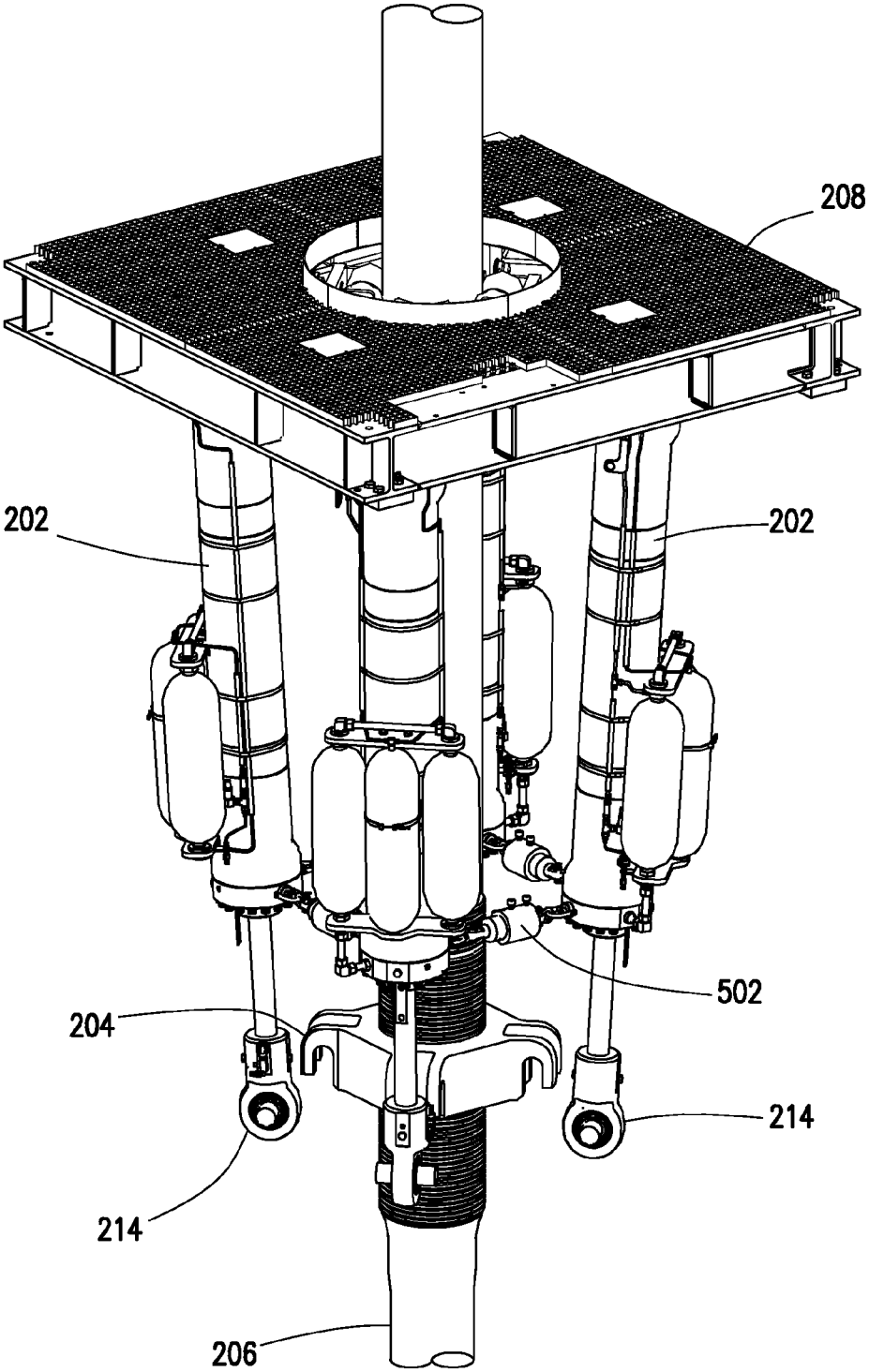
FIGS. 5A-C depict an improved tensioner connection system in accordance with a fourth illustrative embodiment of the present disclosure
Figure 5B:
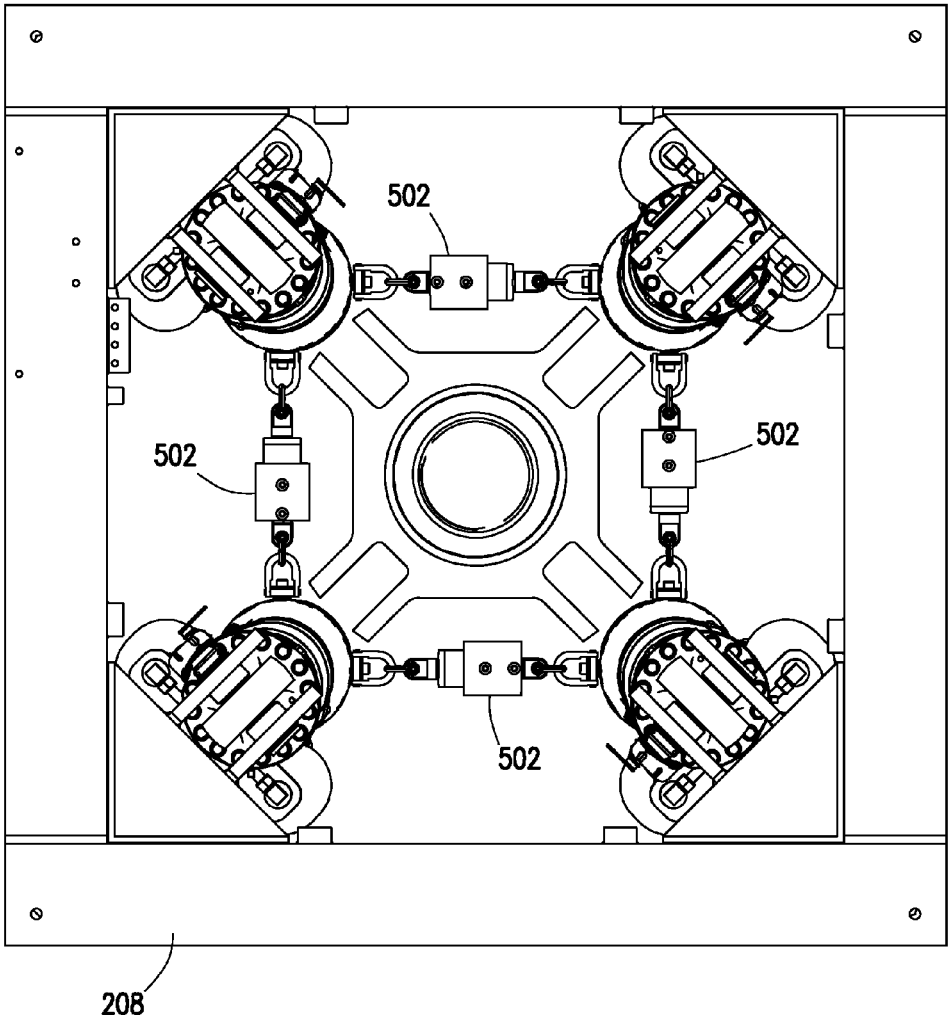
Figure 5C:
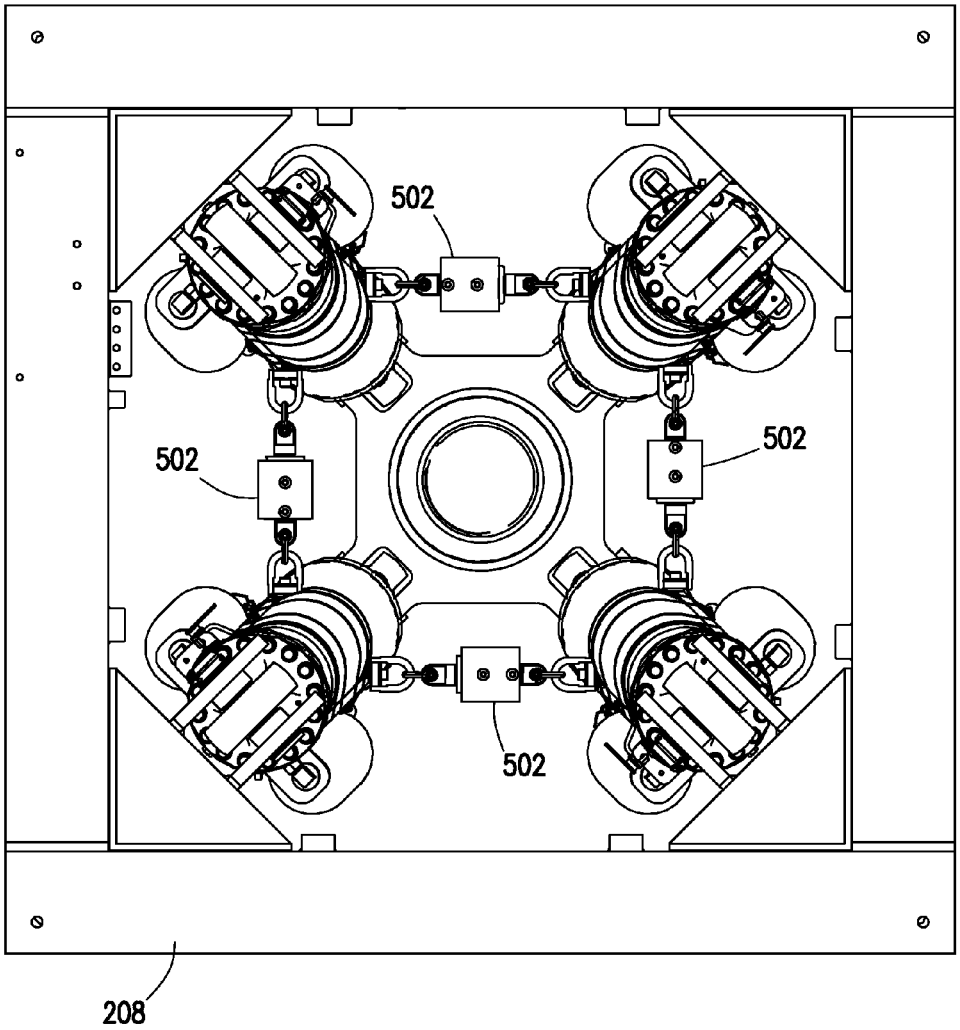

FIGS. 5A-C depict an improved tensioner connection system in accordance with a fourth illustrative embodiment of the present disclosure where the attachment mechanism operates in the same manner discussed in conjunction with FIG. 2 and the positioning mechanism of the adjustable linkage system is designed to pull a plurality of tensioner cylinder 202 against each other rather than against a stationary structure. Specifically, FIG. 5A depicts a perspective view of the improved tensioner connection with the tensioner cylinder 202 not coupled to the tension ring 204; FIG. 5B depicts a top view of the improved tensioner connection with the tensioner cylinder 202 not coupled to the tension ring 204; and FIG. 5C depicts a top view of the improved tensioner connection with the tensioner cylinder 202 coupled to the tension ring 204. Certain components of the embodiment of FIG. 5 operate in the same manner as described in conjunction with FIG. 2 and are identified using the same numerals used in that figure.

In this embodiment, a plurality of tensioner cylinders 202 are equipped with a mechanical link 502 coupled between pairs of adjacent tensioner cylinders 202 as shown in FIGS. 5A-C. The mechanical links 502 may comprise of any suitable linkage device known to those of ordinary skill in the art, having the benefit of the present disclosure. For instance, in certain implementations, the mechanical link 502 may be a pneumatic or hydraulic cylinder connected between an associated pair of tensioner cylinders 202. Specifically, as shown in FIG. 5, a mechanical link 502 is disposed between each pair of tensioner cylinders 202 with a first distal end of the mechanical link 502 coupled to a first tensioner cylinder 202 and a second distal end of the mechanical link 502 coupled to a second tensioner cylinder 202.

After the riser 206 passes through the platform 208 but before the tension ring 204 is at its installation level, the positioning mechanism of the adjustable linkage system (i.e., the mechanical links 502) is activated to pull all the rod extensions 203 of the tensioner cylinders 202 towards each other at the center of the well slot. In certain implementations, a stop may be included to ensure that each tensioner cylinder 202 moves the correct distance. Once all cylinders have been pulled in, the riser 206 is lowered until the tension ring 204 engages the tensioner cylinders 202. In accordance with certain embodiments, a tapered face accounts for any slight misalignment between the tensioner cylinders 202 and the tension ring 204.

Although four tensioner cylinders 202 are depicted in FIGS. 5A-C, the present disclosure is not limited to any particular number of tensioner cylinders. Accordingly, as would be appreciated by those of ordinary skill in the art, having the benefit of the present disclosure, fewer or more tensioner risers may be used without departing from the scope of the present disclosure.

Figure 6A:
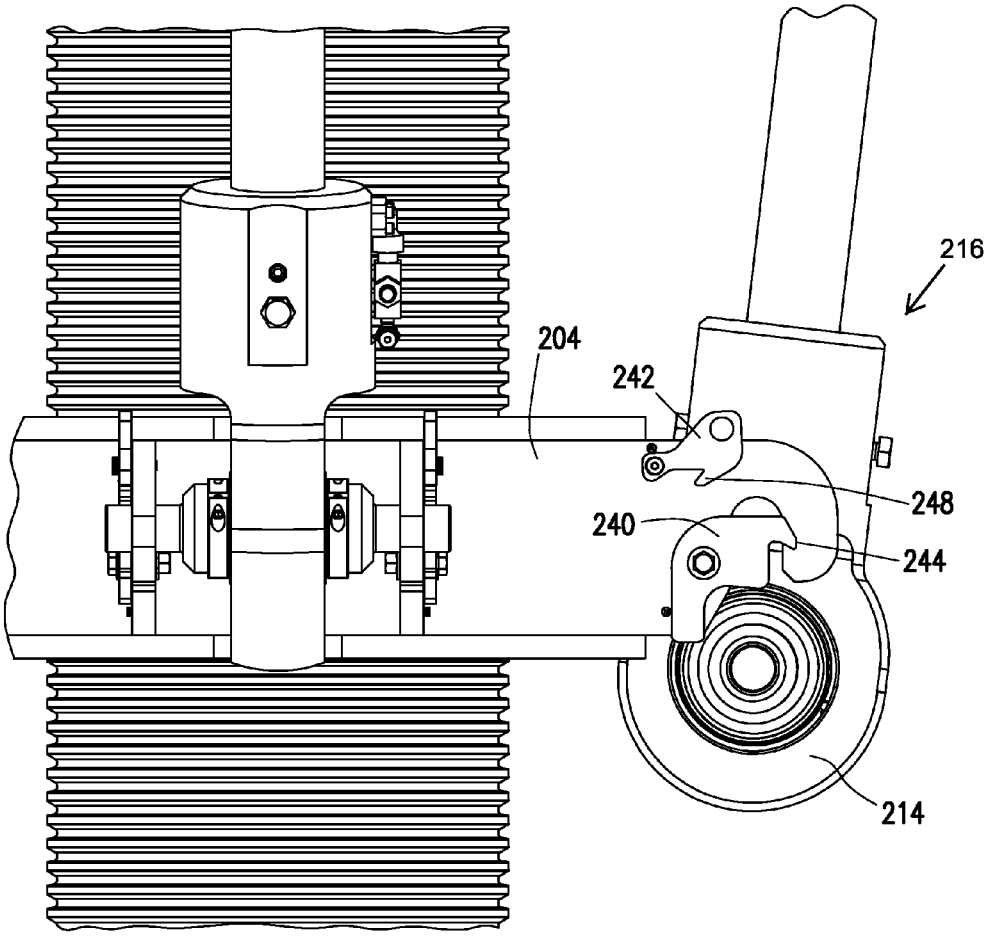
FIGS. 6A and 6B depict a retention device before and after it retains a bottom pin connection in accordance with an illustrative embodiment of the present disclosure.
Figure 6B:
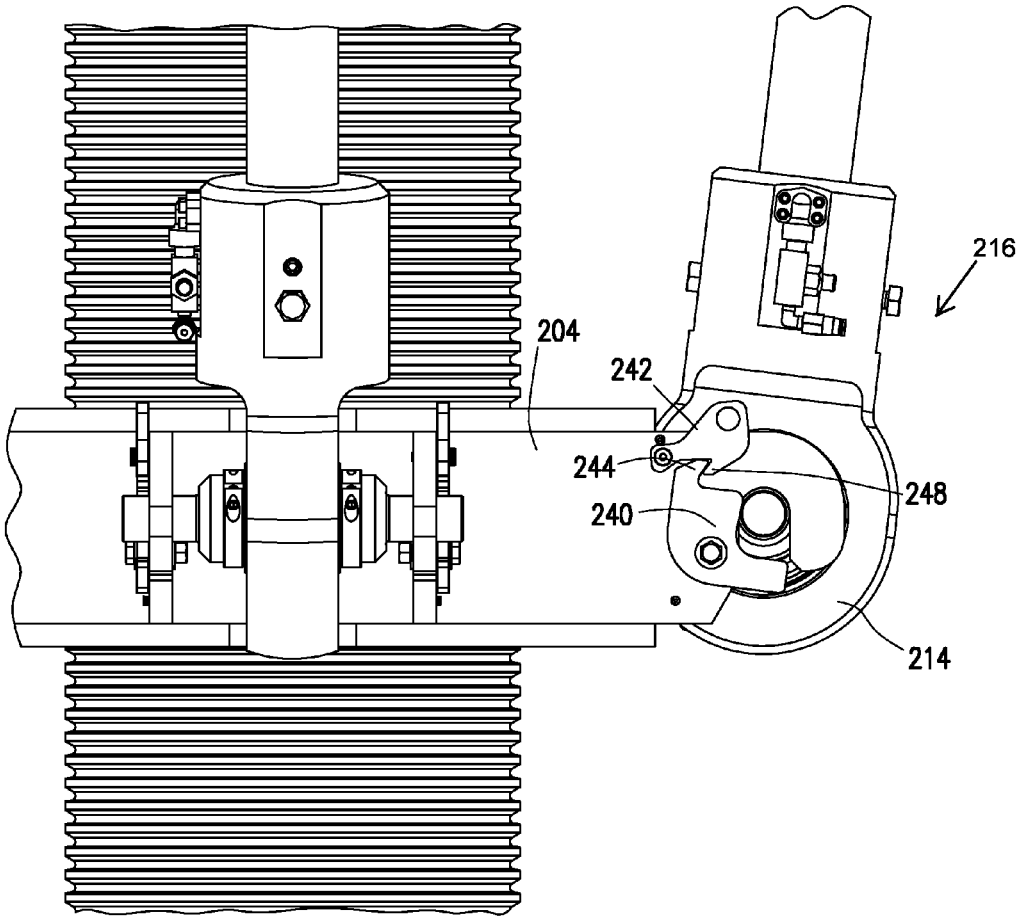

FIGS. 6A and 6B depict the structure of a retention device 216 in accordance with an illustrative embodiment of the present disclosure. The mechanism depicted in FIG. 6 is used as an illustrative example and other mechanisms may be used to implement the retention device 216 without departing from the scope of the present disclosure. Specifically, FIG. 6A depicts the bottom pin connection 214 just before it is retained in the retention device 216 and FIG. 6B depicts the bottom pin connection 214 after it has been securely retained in the retention device 216. In the illustrative embodiment of FIG. 6, the retention device 216 of the tension ring 204 includes a first moving member 240 and a second moving member 242 pivotally coupled to the tension ring 204. The first moving member 240 includes a first lip 244 and the second moving member 242 includes a second lip 248. As the bottom pin connection 214 is pulled into the retention device 216, the first moving member 240 rotates until the first lip 244 engages the second lip 248 as shown in FIG. 6B. Once the first lip 244 engages the second lip 248, the first moving member 240 and the second moving member 242 securely retain the bottom pin connection 214 in place within the retention device 216.

As would be appreciated by those of ordinary skill in the art, having the benefit of the present disclosure, although pneumatic cylinders are used to implement the positioning mechanism of the adjustable linkage system of certain embodiments discussed thus far, the present disclosure is not limited to that particular implementation. Specifically, any suitable mechanical means may be used in implementing the positioning mechanism of the adjustable linkage system without departing from the scope of the present disclosure. For instance, in certain implementations, the pneumatic cylinders of the positioning mechanism of the adjustable linkage system may be replaced with an electric motor or a manual winch.

Typically, personnel must use a temporary access platform to access the tension ring and there are often space constraints. Moreover, when coupling the tensioner cylinders to the tension ring the personnel is often at risk of injury from working at close proximity to heavy moving components. Accordingly, the methods and systems disclosed herein which do not require personnel to physically couple the tensioner cylinders to the tension ring result in improved operational safety. Further, the improved methods and systems disclosed herein allow the installation steps to be performed above the production deck and reduce the riser run time. In certain implementations, the adjustable linkage system may be installed ahead of time so that it does not impact the schedule. Additionally, the quick connection of the tensioner ring with the riser can be done significantly faster than traditional methods of aligning a pin with spherical bearing or manually installing a shackle.

Accordingly, in accordance with embodiments of the present disclosure, a hands free method and system for coupling one or more tensioner cylinders to a tension ring are disclosed. As a result, the tensioner cylinders of the tensioning system may be coupled to the tension ring quickly, saving rig time. Additionally, the methods and systems disclosed herein provide a safer environment for rig personnel. Moreover, in certain implementations, the methods and systems disclosed herein eliminate the need for a platform structure access deck.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system for coupling a tensioner cylinder to a riser comprising:

a top pin connection disposed at a first distal end of the tensioner cylinder, wherein the top pin connection rotatably couples the tensioner cylinder to a platform;

wherein the tensioner cylinder comprises an extension rod;

a bottom pin connection disposed at a second distal end of the tensioner cylinder, wherein the bottom pin connection is disposed on the extension rod;

a tension ring coupled to the riser;

an adjustable linkage system coupled to the tensioner cylinder, the adjustable linkage system comprising an attachment mechanism and a positioning mechanism, wherein the adjustable linkage system is operable to couple the tensioner cylinder to the tension ring;

wherein the attachment mechanism comprises a retention device disposed on the tension ring, wherein the positioning mechanism rotates the tensioner cylinder about the top pin connection between a first position and a second position; and wherein the bottom pin connection is disengaged from the retention device when the tensioner cylinder is in the first position, and wherein the bottom pin connection is directly engaged with the retention device when the tensioner cylinder is in the second position.

2. The system of claim 1, wherein the retention device is activatable to lock the bottom pin connection against the tension ring.

3. The system of claim 2, wherein the retention device is selectively activated and deactivated.

4. The system of claim 1, wherein the positioning mechanism comprises:

a flexible member, wherein a first distal end of the flexible member is coupled to a mounting point on the tensioner cylinder; and a rotation device coupled to the platform, wherein a second distal end of the flexible member is coupled to the rotation device.

5. The system of claim 1, wherein the positioning mechanism comprises a double acting rotation mechanism, the double acting rotation mechanism comprising a double acting rotation cylinder, wherein the double acting rotation cylinder is coupled to the tensioner cylinder via a solid link.

6. The system of claim 1, wherein the positioning mechanism comprises a mechanical link, wherein a first distal end of the mechanical link is coupled to the tensioner cylinder and a second distal end of the mechanical link is coupled to a cylinder on the platform.

7. The system of claim 6, wherein the mechanical link is routed through the tension ring.

8. The system of claim 6, wherein the cylinder is selected from a group consisting of a hydraulic cylinder and a pneumatic cylinder.

9. The system of claim 6, wherein the mechanical link is a non-marring strap.

10. The system of claim 6, wherein the tensioner cylinder moves towards the tension ring as the tension ring is lowered.

11. The system of claim 1, wherein the system comprises a first tensioner cylinder and a second tensioner cylinder and wherein the positioning mechanism comprises a mechanical link, wherein a first distal end of the mechanical link is coupled to the first tensioner cylinder and a second distal end of the mechanical link is coupled to the second tensioner cylinder.

12. The system of claim 11, wherein the positioning mechanism is operable to move the first tensioner cylinder and the second tensioner cylinder towards each other.

13. The system of claim 1, wherein the adjustable linkage system is removably coupled to the tensioner cylinder.

14. A method of coupling one or more tensioner cylinders to a riser comprising:

coupling a tension ring to the riser;

rotatably coupling a first distal end of a first tensioner cylinder to a platform at a top pin connection;

providing a bottom pin connection at a second distal end of the first tensioner cylinder;

coupling an adjustable linkage system to the first tensioner cylinder, the adjustable linkage system comprising an attachment mechanism and a positioning mechanism;

activating the positioning mechanism, wherein the positioning mechanism rotates the first tensioner cylinder about the top pin connection between a first position and a second position; and activating the attachment mechanism, wherein the attachment mechanism comprises a retention device disposed on the tension ring, and wherein the attachment mechanism couples the bottom pin connection of the first tensioner cylinder to the tension ring;

wherein the bottom pin connection is disengaged from the retention device when the tensioner cylinder is in the first position, and wherein the bottom pin connection is directly engaged with the retention device when the tensioner cylinder is in the second position.

15. The method of claim 14, wherein the positioning mechanism comprises:

a flexible member, wherein a first distal end of the flexible member is coupled to a mounting point on the first tensioner cylinder; and a rotation device coupled to the platform, wherein a second distal end of the flexible member is coupled to the rotation device.

16. The method of claim 14, wherein the positioning mechanism comprises a double acting rotation mechanism, the double acting rotation mechanism comprising a double acting rotation cylinder, wherein the double acting rotation cylinder is coupled to the first tensioner cylinder via a solid link.

17. The method of claim 14, wherein the positioning mechanism comprises a mechanical link, wherein a first distal end of the mechanical link is coupled to the first tensioner cylinder and a second distal end of the mechanical link is coupled to a cylinder on the platform.

18. The method of claim 17, further comprising routing the mechanical link through the tension ring.

19. The method of claim 17, wherein the cylinder is selected from a group consisting of a hydraulic cylinder and a pneumatic cylinder.

20. The method of claim 17, wherein the mechanical link is a non-marring strap.

21. The method of claim 17, further comprising lowering the tension ring, wherein the tensioner cylinder moves towards the tension ring as the tension ring is lowered.

22. The method of claim 14, further comprising rotatably coupling a first distal end of a second tensioner cylinder to the platform at a top pin connection;

providing a bottom pin connection at a second distal end of the second tensioner cylinder;

coupling the second tensioner cylinder to the adjustable linkage system; and coupling the bottom pin connection of the second tensioner cylinder to the tension ring.

23. The method of claim 22, wherein the positioning mechanism comprises a mechanical link; wherein a first distal end of the mechanical link is coupled to the first tensioner cylinder and a second distal end of the mechanical link is coupled to the second tensioner cylinder; and wherein activating the positioning mechanism moves the first tensioner cylinder and the second tensioner cylinder towards each other.

* * * * *